United States Patent [19]

Pamm

[11] 4,281,042

[45] Jul. 28, 1981

[54] POLYESTER FIBERFILL BLENDS

[75] Inventor: Georges Pamm, Geneva, Switzerland

[73] Assignee: E. I. Du Pont de Nemours and Company, Wilmington, Del.

[21] Appl. No.: 71,196

[22] Filed: Aug. 30, 1979

[51] Int. Cl.[3] ..... D02G 3/00

[52] U.S. Cl. ..... 428/361; 428/288; 428/359; 428/362; 428/391; 428/395

[58] Field of Search ..... 428/288, 290, 359, 361, 428/362, 391, 395, 375, 378

[56] References Cited

U.S. PATENT DOCUMENTS

| | | | |
|---|---|---|---|
| 3,118,750 | 1/1964 | Dunlap et al. | 428/369 X |
| 3,271,189 | 9/1966 | Hofmann | 428/369 |
| 3,454,422 | 7/1969 | Mead et al. | 428/361 |
| 3,499,810 | 3/1970 | Wagle | 428/361 X |
| 3,589,956 | 6/1971 | Kranz et al. | 428/369 X |
| 3,772,137 | 11/1973 | Tolliver | 428/398 |
| 4,040,371 | 8/1977 | Cooper et al. | 428/361 X |
| 4,068,036 | 1/1978 | Stanistreet | 428/369 |
| 4,129,675 | 12/1978 | Scott | 428/288 |
| 4,167,604 | 9/1979 | Aldrich | 428/361 X |
| 4,199,642 | 4/1980 | Cooper | 428/288 |

FOREIGN PATENT DOCUMENTS 1168759 10/1969 United Kingdom .

OTHER PUBLICATIONS

Research Disclosure Journal, Sep. 1975, p. 14, No. 13717.

Fiberseal, Dacron ® 99 Polyester Fiberfill by Du Pont, Jul. 19, 1977.

*Primary Examiner*—Lorraine T. Kendell

[57] ABSTRACT

A fiberfill blend for making into a batt for heat-bonding, consisting essentially of three ingredients: (a) two of the ingredients are crimped polyester staple fiber; (1) one of these polyester fiberfill ingredients is slickened with a durable coating; (2) the other of these polyester fiberfill ingredients is unslickened; each of ingredients (1) and (2) constitutes 25 to 75% of the polyester fiberfill (a); (b) the third ingredient is crimped binder fiber of a polymer having a melting point lower than that of the (a) ingredients; the binder fiber is present in amount 10 to 30% of the blend; the remaining 70 to 90% of the blend is the polyester fiberfill. Such blends can be processed on conventional textile machinery, e.g., by carding and cross-lapping, and heated to activate the binder fibers and make a stable heat-bonded batt. Preferred batts, using polyester staple fibers of regular denier, have surprisingly high resilience, which makes them especially suitable for use in pillows and cushions.

7 Claims, No Drawings

POLYESTER FIBERFILL BLENDS

DESCRIPTION

TECHNICAL FIELD OF THE INVENTION

This invention relates to new polyester fiberfill blends, such as can be made into batts for heat-bonding and subsequent use in the form of a bonded batt.

BACKGROUND

Polyester fiberfill is used commercially in many end-uses, including pillows and cushions, because of its economic value and desirable aesthetic and nonallergenic properties. Hereinafter the term pillow is often used generically to cover cushions. Most commercial polyester has been in the form of crimped polyester staple fiber of denier about 5–6.

Generally, heretofore, in the manufacture of pillows and cushions, a rolled batt of fluffy unbonded polyester fiberfill has been stuffed into a cover (often referred to as ticking), as disclosed in LeVan U.S. Pat. No. 3,510,888. The pillow or cushion is then forcibly manipulated to redistribute the polyester fiberfill into the shape desired. It has not been customary to bond polyester fiberfill for use in pillows except that a light coating of resin is sometimes used to assist in handling batts and to prevent fiber from sticking through the ticking.

It has generally been considered desirable to maximize the bulk of the polyester fiberfill used in pillows to increase the softness and fluffability. One prior suggestion for improving bulk has been the use of hollow polyester fiberfill, e.g., as disclosed in British Patent No. 1,168,759 and Tolliver U.S. Pat. No. 3,772,137. Another prior suggestion for improving bulk and bulk stability has been to provide the polyester fiberfill with a coating of durable (e.g., wash-resistant) silicone slickener (cured polysiloxane), e.g., as disclosed in Hofmann U.S. Pat. No. 3,271,189 and Mead et al. U.S. Pat. No. 3,454,422.

Pillows filled with polyester fiberfill do not generally have such high resilience as polyurethane foam-filled pillows, but generally have superior softness and down-like aesthetics. It would be desirable to increase the resilience of the polyester fiberfill, when in the pillow, without losing its desirable down-like aesthetics.

Research Disclosure Journal (September 1975) Article No. 13717, page 14, discloses the inclusion in polyester fiberfill of a specific low melting point binder fiber, poly(ethylene terephthalate/isophthalate), and its bonding to improve the stability and handling characteristics of the fiberfill, e.g., in batts, including batts to which polysiloxane slickeners have been applied. Mixtures of polyester fiberfill with lower melting binder fiber are also suggested elsewhere, e.g., in Scott U.S. Pat. No. 4,129,675, which discloses forming a web having a central band made from silicone-slickened polyester hollow fiberfill and outer bands made from a blend of unslickened hollow polyester fiberfill and binder fiber, and forming a batt having a center layer of such silicone-slickened polyester fiberfill and upper and bottom layers of said blend. Stanistreet U.S. Pat. No. 4,068,036 suggests the use of conjugate or bicomponent fibers for use as binder fibers in fiberfill blends.

SUMMARY OF THE INVENTION

The present invention provides new 3-component blends consisting essentially of (a) from about 70 to about 90% by weight of crimped polyester staple fiber and (b) complementally, to total 100% by weight, from about 10 to about 30% of crimped staple binder fiber of a polymer having a melting point lower than that of said polyester fiber, wherein from about 25 to about 75% by weight of said polyester fiber is slickened with a cured polysiloxane coating and the remainder of the polyester fiber is unslickened.

Blends of the invention can be processed on conventional textile machinery, e.g., by carding and cross-lapping, and heated to make a heat-bonded batt of surprisingly high resilience, which makes them suitable for use in pillows, with the down-like aesthetics associated with polyester fiberfill.

Preferred proportions of the blend are, by weight, approximately as follows: 20–25% binder fiber; 25–40% unslickened polyester fiber; and the remainder (about 35–55%) slickened polyester fiber.

DETAILED DESCRIPTION OF THE INVENTION

The preferred polyester staple fiber for essential ingredients (a) (1) and (2) is poly(ethylene terephthalate), which is available commercially at relatively low cost and provides good bulk and tactile aesthetics. This polyester fiber (a) constitutes the predominant proportion of the blend, namely about 70 to about 90% by weight, and remains in the form of polyester fiberfill in the batt and in any end-use article even after heat-bonding. Preferably, the slickened ingredient (1) and the unslickened ingredient (2) are present in equal proportions by weight (50:50). The proportion of slickened ingredient (1) may, however, be increased or decreased so that the ratio of slickened (1): unslickened (2) ingredients is from 3:1 to 1:3. The use of both slickened and unslickened polyester fiberfill in combination with binder fibers is an essential characteristic of the present invention. The slickened polyester fiber is included in the blend to impart softness and down-like aesthetics. It is important that the slickener be durable in the sense of being wash-resistant, so that the slickener be retained on the polyester fiberfill during normal laundering. Suitable slickeners are polysiloxane coating compositions that are available commercially, and are mentioned in the prior art, e.g., in Hofmann U.S. Pat. No. 3,271,189 and Mead et al. U.S. Pat. No. 3,454,422, the disclosures of which are incorporated herein by reference. More than one type of slickener may be used, if desired. Unslickened polyester fiber is included in the blend to provide potential bonding sites where the unslickened polyester fibers cross over. The combination, in the final heat-bonded batt, of the slickened polyester fibers (which are relatively free from bonding and provide desirable tactile aesthetics) with the unslickened fibers (which provide bonding sites at their cross-over points, and so make possible the provision of increased resilience) is an important characteristic of the new blends, which are precursors of the heat-bonded batts that are used in the final articles, e.g., pillows.

It will be understood that, since an important characteristic of the invention is the use of both slickened polyester fiberfill and unslickened polyester fiberfill, slickener is applied to only a portion of the polyester fiberfill, and then cured as a coating thereon before blending the slickened fiberfill with the unslickened polyester fiberfill and the binder fiber. It will generally be convenient to use the same polyester fiberfill for both slickened and unslickened ingredients, but this is not essential.

Polyester fiberfill of regular denier about 4 to about 6 is preferred in blends for batts to be used in pillows, but it will be understood that a wide range of deniers are also suitable, and different deniers may be preferred for other end-uses within a broad range of 0.5 to 40, as indicated hereinafter, with a range of 0.5 to 15 being indicated for some purposes, especially 0.5 to about 6. For instance, waste polyester filaments of varying denier may be economically advantageous and, therefore, preferred in some circumstances.

The third essential ingredient of the blend is the binder fiber. During heat-setting, the binder fiber melts and bonds the unslickened polyester fiberfill at the cross-over points so that the bonded batt retains the desired configuration and density. Because the binder is in the form of crimped fiber, like the polyester fiberfill, it can be processed on conventional textile machinery, e.g., a card, and be distributed throughout the blend. It is desirable, therefore, that the denier of the binder fiber be compatible with the denier of the polyester fiberfill (a) so that the binder fiber can be distributed throughout the blend by conventional textile processing. The denier of the binder fiber will generally be about 0.5 to about 6. It is generally preferable to process binder fiber of substantially the same denier as that of the polyester staple fiber (a), but a satisfactory result can be obtained by using binder fiber of different denier.

The amount of binder fiber is about 10 to about 30% of the blend, and preferably about 20–25% of the blend (i.e., a proportion of 1:4 to 1:3 binder fiber: polyester fiber). As the proportion of binder in the blend is increased, the resulting heat-bonded batts will generally have greater rigidity, since the amount of bonding will depend most importantly on whether binder is available to bond the unslickened polyester fiber at the cross-over points, and the statistical probability of this increases with an increase in the amount of binder and with an increase in the amount of unslickened polyester fiber. It will be understood that binder fiber is not generally present as such in the heat-bonded batts, because the binder fiber will generally melt during the heat-bonding and will then congeal on the polyester fiber during the subsequent cooling stage.

The binder fiber has a lower melting point than the polyester fiberfill. The binder fiber preferably has a stick temperature above about 80° C. and below that of the polyester fiberfill. Preferred binder fiber has a stick temperature between 80° and 200° C. Fiber stick temperature is measured as described by Beaman and Cramer, J. Polymer Science 21, page 228 (1956). A flat brass block is heated electrically to raise the block temperature at a slow rate. The fiber sample is suspended under slight tension between glass rods over and near the surface of the block. At intervals, the fiber is pressed against the block for 5 seconds with a 200 gram brass weight which has been in continuous contact with the heated block. The fiber stick temperature is the temperature of the block when the fiber sticks to it for at least 2 seconds after removing the weight.

Suitable binder fibers are described in the aforesaid Research Disclosure Journal (September 1975) Article No. 13717 on page 14, Scott U.S. Pat. No. 4,129,675 and in Stanistreet U.S. Pat. No. 4,068,036, the disclosures of which are incorporated herein by reference.

A preferred binder is composed of an ethylene terephthalate/isophthalate copolymer having a terephthalate/isophthalate molar ratio of about 65–75/35–25, and having a stick temperature of about 90° C. Such binder fiber may be used in the form of cold-drawn, relaxed fiber that has low tendency to shrink.

The staple length and crimp level of the polyester fiberfill and of the binder fiber are those conventionally used, e.g., about 3 to 15 cm and 1 to 5 crimps/cm, respectively.

If desired, the binder fiber may be in the form of a bicomponent fiber, e.g., a sheath-core fiber, the sheath of which comprises the lower melting binder polymer, as suggested in Stanistreet U.S. Pat. No. 4,068,036. In such circumstances, it is desirable to use sufficient bicomponent fiber so that the amount of binder polymer is from about 10 to about 30% of the total weight of binder polymer and polyester fiberfill.

The new blends are generally formed by conventional blending of the ingredients and then processed through standard carding equipment to give an unbonded batt of desired weight. The batt is processed as desired. At an appropriate time, the batt, or an article such as a pillow filled therewith, as appropriate, is heat-treated, e.g., in an oven or by use of other heating means, e.g., by infrared heating, to melt the binder fibers distributed throughout. Suitable processes are described in the following Examples, in which all percentages are by weight, and are calculated with respect to the total of the three essential ingredients, namely (a) (1) slickened polyester fiberfill, (a) (2) unslickened polyester fiberfill and (b) binder fiber, except as otherwise indicated.

EXAMPLE 1

Approximately 1.5 pounds (0.7 kg) of the following blend was prepared by hand-mixing:

(a) (1) 50% of crimped hollow poly(ethylene terephthalate) staple fiber of denier 5.5 and of staple length 2.5 in (about 6.4 cm), coated with a commercial silicone-oil emulsion in amount 1.4% of silicone solids based on the weight of silicone-slickened polyester fiber;

(a) (2) 25% of crimped hollow poly(ethylene terephthalate) staple fiber of denier 5.5 and of staple length 2.5 in (about 6.4 cm) as in (a) (1) but unslickened, and (b) 25% of crimped fiber of denier 6, and of staple length 2 in (about 5 cm), made from an ethylene terephthalate/isophthalate copolymer having a terephthalate/isophthalate mole ratio of 70/30, of stick temperature of about 90° C., and of low shrinkage.

This blend was carded to give intimately-blended webs which were plied to give a batt of weight approximately 9 oz/yd$^2$ (310 g/m$^2$). Portions of the batt were formed into pillows by the following techniques.

A. The batt was rolled and stuffed into standard pillow ticking of dimensins 20×26 inches (50×66 cm). The fiberfill blend was heat-bonded by suspending the pillow by 2 corners in an oven at 375° F. (190° C.) for about 1 hour, and cooling, and then the bonded fiberfill was removed from the ticking and stuffed into similar fresh ticking.

B. Two batts, each of weight 12.5 oz (355 g) and of the same dimensions but half the thickness of A, were treated in the oven at 375° F. (190° C.) for half an hour. The bottoms of such batts were flat and stiffer than the tops owing to contact with the bottom of the oven, so two of these flat surfaces were placed face-to-face and the two batts were thus stuffed into similar pillow ticking.

C. Unbonded batt similar to that in A was heat-bonded at 375° F. (190° C.) for 5 minutes in a conveyor-type oven. 20 oz (576 g) of such heat-bonded batt was rolled and stuffed into similar pillow ticking.

Each of the above Pillows A, B and C were judged to have similar down-like aesthetics but significantly superior resilience compared with a Control I, a standard commercial pillow containing slickened polyester fiberfill, (a) (1) above, i.e., without binder fiber or unslickened polyester fiberfill ingredients. This was unexpected and very surprising. The improved resilience of these pillows according to the Examples was verified by measuring their work recovery in comparison with Control I, and their resilience was also compared with a standard commercial polyurethane foam-filled pillow, Control II (which does not show down-like aesthetics), as indicated in the Table below:

TABLE

| Pillows | Work Recovery % |
|---|---|
| Control I | 50 |
| Example | 60 |
| Control II | 75 |

The work recovery was calculated by using an Instron machine, operated with a 20 lb (9 kg) load on a 4 inch (10 cm) diameter foot at a cross-head speed of 10 inches (25 cm)/min, to measure the Force x Distance integral for the compression of the pillow and to measure the same integral for the recovery of the pillow, by dividing the recovery integral by the compression integral, and expressing the result as a percentage.

The fiberfill pillows showed a similar height recovery of 92%, when tested on the Instron machine under the same conditions, whereas the foam pillow showed a 98% height recovery.

It will be recognized that other methods of using the 3-component blends of the invention are possible as is known to those skilled in this art. For instance, pillows can be made by blowing the blend into a ticking and then heating to set the binder.

Example 2 shows the surprisingly good thermal insulation provided by stable thin needle-punched heat-treated batts from 3-component blends of binder fiber spun with low denier (0.5 to 3 denier) polyester fiberfill (slickened and unslickened).

EXAMPLE 2

Approximately 2 pounds (1.8 kg) of the following blend was prepared by hand-mixing:

(a) (1) 40% of crimped solid poly(ethylene terephthalate) staple fiber of denier 1.5 and of staple length 1.5 in (about 4 cm), coated with a commercial silicone-oil emulsion in amount 1.4% of silicone solids based on the weight of silicone-slickened polyester fiber;

(a) (2) 40% of crimped poly(ethylene terephthalate staple fiber of denier 1.5 and of staple length 1.5 in (about 4 cm) as in (a) (1) but unslickened, and (b) 20% of crimped fiber of denier 6, and of staple length 2 in (about 5 cm), made from an ethylene terephthalate/isophthalate copolymer having a terephthalate/isophthalate mole ratio of 70/30, of stick temperature of about 90° C., and of low shrinkage.

This blend was carded to give intimately-blended webs which were plied to give a batt of weight approximately 7.2 oz/yd$^2$ (245 g/m$^2$). The batt was needle-punched with nine-barbed needles at about 250 punches per in$^2$ (40 per cm$^2$) to increase the batt density to 0.8 lb/ft$^3$ (7.5 kg/m$^3$). The needled batt was then heat-set in an oven at 375° F. (about 190° C.) for 5 minutes. After cooling, the batt had a density of (0.93 lb/ft$^3$ (8.7 kg/m$^3$).

A sample (1 foot square, corresponding to about 30 cm×30 cm) weighing 22.2 g was sandwiched between two layers of a nylon fabric weighing 6.3 g/ft$^2$ (68 g/m$^2$) to give a composite of thickness 0.63 in (about 1.6 cm) and weighing 34.3 g. The thermal conductivity of the composite was only 0.284 BTU/hr.ft$^2$ (°F./in) (4.085 kiloergs/sec.cm$^2$ (°C./cm)) measured between a hot plate at 05° F. (about 34° C.) and a cold plate at 55° F. (about 13° C.). This corresponds to a thermal insulation of CLO of 2.52, which can be calculated as 1.58 CLO/cm; note that a higher CLO value corresponds to better thermal insulation. This thermal insulation of 1.58 CLO/cm was significantly higher than that calculated for a conventional fabric of the same thickness using mainly slickened polyester fiberfill of conventional denier (5.5), as shown by the following comparative test:

A. A similar composite was prepared of thickness 0.64 in (1.6 cm) and of weight 35.2 g, 22.6 g of which comprised the heat-bonded polyester fiberfill batt. The thermal conductivity was measured by the same procedure as above. The CLO values are listed in the following Table.

B. For comparative purposes, the thermal conductivity was measured by the same procedure for a composite of the same weight, covered by the same nylon fabric, and the same weight of fiberfill, but using a batt of conventional commercial fiberfill comprising a central layer of silicone-slickened hollow polyester fiberfill in amount 60% by weight, and two outer layers of unslickened hollow polyester fiberfill, each in amount 20% by weight, this batt having been surface-spray bonded, by spraying on both sides with a commercial acrylic binder resin in total amount 10% by weight of the total fiberfill, i.e., 5% by weight on each surface, followed by heat-bonding. The CLO values for this composite are listed in the Table as B1 for the composite in its natural bulky form and as B2 for the same composite compressed to the same thickness as Composite A.

TABLE

| Item | Thickness in (cm) | CLO | CLO/100 g | CLO/cm |
|---|---|---|---|---|
| A | 0.64 (1.6) | 2.56 | 7.29 | 1.58 |
| B1 | 1.78 (4.5) | 4.00 | 11.37 | 0.89 |
| B2 | 0.64 (1.6) | 2.04 | 5.8 | 1.26 |

Although the thermal insulation provided by the same weight of the bulky conventional material (B1) is greater than that provided by the thinner fabric produced from the blend of Example 2, this conventional material is also of much greater thickness, which is sometimes inconvenient. So, when comparing equivalent thicknesses of the two materials, significantly better thermal insulation is provided by the thin fabric (A) of the present Example, as can be seen by comparing the CLO/cm Values for A and B1, or by comparing any of the above insulation values for A and B2.

I claim:

1. A polyester fiberfill blend consisting essentially of (a) from about 70 to about 90% by weight of crimped polyester staple fiber and (b) complementally, to total 100% by weight, from about 10 to about 30% of crimped staple binder fiber of a polymer having a melting point lower than that of said polyester fiber, wherein from about 25 to about 75% by weight of said polyester fiber is slickened with a cured polysiloxane coating and the remainder of said polyester fiber is unslickened.

2. A blend according to claim 1, wherein said polyester fiber is poly(ethylene terephthalate).

3. A blend according to claim 1 or 2, wherein the binder fiber is of an ethylene terephthalate/isophthalate copolyester having a terephthalate/isophthalate molar ratio of 65–75/35–25 and a stick temperature of about 90° C.

4. A blend according to claim 1 or 2, wherein the fibers are of denier about 0.5 to about 15.

5. A blend according to claim 1 or 2, wherein said polyester fiber is of denier about 4 to about 6.

6. A blend according to claim 1, consisting essentially of about 20 to 25% by weight of said binder fiber of denier about 0.5 to about 6, about 25 to 40% by weight of said polyester fiber that is unslickened and of denier about 4 to about 6, and the remainder being said polyester fiber that is slickened with a cured polysiloxane coating and of denier about 4 to about 6.

7. A blend according to claim 6, wherein said polyester fiber is of poly(ethylene terephthalate) and of denier about 5.5, and said binder fiber is of an ethylene terephthalate/isophthalate copolymer having a terephthalate/isophthalate mole ratio of 70/30 and a stick temperature of about 90° C. and of denier about 0.5 to about 6.

* * * * *